United States Patent [19]

Wiedemann

[11] 4,315,981

[45] Feb. 16, 1982

[54] ORGANIC DOUBLE LAYER ELECTROPHOTOGRAPHIC RECORDING MATERIAL

[75] Inventor: Wolfgang Wiedemann, Geisenheim-Johannisberg, Fed. Rep. of Germany

[73] Assignee: Hoechst Aktiengesellschaft, Fed. Rep. of Germany

[21] Appl. No.: 882,706

[22] Filed: Mar. 2, 1978

Related U.S. Application Data

[63] Continuation of Ser. No. 758,896, Jan. 13, 1977, abandoned, which is a continuation of Ser. No. 587,771, Jun. 17, 1975, abandoned, which is a continuation of Ser. No. 354,184, Apr. 25, 1973, abandoned.

[51] Int. Cl.[3] ..... G03G 5/06

[52] U.S. Cl. ..... 430/59; 430/69; 430/74; 430/900

[58] Field of Search ..... 96/1 S, 1 SC, 1.6; 252/501; 430/59, 69, 74, 900

[56] References Cited

U.S. PATENT DOCUMENTS

| | | | |
|---|---|---|---|
| 3,287,120 | 11/1966 | Hoegl | 96/1 S |
| 3,598,582 | 8/1971 | Herrick | 96/1 S |
| 3,861,913 | 1/1975 | Chiou | 96/1 S |
| 3,877,935 | 4/1975 | Regensburger | 96/1 S |

*Primary Examiner*—John D. Welsh

*Attorney, Agent, or Firm*—James E. Bryan

[57] ABSTRACT

This invention relates to an electrophotographic recording material consisting of an electroconductive support material and a photoconductive double layer of organic materials which consists of a homogeneous, opaque, charge carrier producing dyestuff layer from a more annealed quinone or the substitution product thereof, selected from the group consisting of dibenzopyrene quinone, anthanthrone, pyranthrone, dibenzanthrone, and flavanthrone, possible substituents being halogen, nitro, amino, hydroxy, alkoxy, mercapto or alkyl mercapto groups, and of a transparent top layer of insulating materials with at least one charge transporting compound.

1 Claim, 3 Drawing Figures

ORGANIC DOUBLE LAYER ELECTROPHOTOGRAPHIC RECORDING MATERIAL

This is a continuation of application Ser. No. 758,896, filed Jan. 13, 1977, abandoned, in turn, a continuation of Ser. No. 587,771, filed June 17, 1975 now abandoned, in turn, a continuation of Ser. No. 354,184, filed Apr. 25, 1973, and now abandoned.

This invention relates to electrophotographic recording material consisting of an electroconductive support material and a photoconductive double layer of organic materials which consists of a homogeneous, opaque, charge carrier producing dyestuff layer from a more annealed quinone or the substitution product thereof, selected from the group consisting of dibenzopyrene quinone, anthanthrone, pyranthrone, dibenzanthrone, and flavanthrone, possible substitutents being halogen, nitro, amino, hydroxy, alkoxy, mercapto or alkyl mercapto groups, and of a transparent top layer of insulating materials with at least one charge transporting compound.

It is known from German Offenlegungsschriften Nos. 1,597,877 and 1,797,342 for electrophotographic recording material to extend the spectral sensitivity of selenium layers to the red spectral range by a double layer arrangement, e.g. with phthalocyanine dispersion layers. Disadvantageous are the vacuum vapour depositions of selenium requiring high technical expenditure, the brittleness of comparatively thick selenium layers, the poor adhesion of adjacent heterogeneous constituents in these layers and the only difficulty realizable uniformly wetting coating with the corresponding dispersions. Furthermore, no optimum light-sensitivities can be achieved as a result of the absorption behaviour and the different charge conducting mechanisms of selenium and phthalocyanine in the double layer arrangement.

From U.S. Pat. No. 3,573,906, for example, there are also known photoconductive layers containing an organic, possibly photoconductive, insulating layer between the support material and the vapor-deposited selenium layer in order to impart adhesion. Such a layer construction, however, considerably hinders the necessary charge transport so that, in this case too, no higher light-sensitivities are obtainable.

Furthermore, from German Auslegeschrift No. 1,964,817, it is known to provide vapor-deposited selenium layers with a layer of an organic, photoconductive insulating material which is substantially insensitive to light in the visible range of the spectrum. According to German Offenlegungsschrift No. 2,120,912, it has also been suggested to use those light-sensitive layer arrangements for electrophotographic recording materials which contain, as the charge carrier producing layer, an inorganic material, such as the sulfide, selenide, sulfoselenide or telluride of cadmium or zinc, and as the charge carrier transporting layer, an organic material with at least 20 per cent by weight of 2,4,7-trinitro-9-fluorenone. A disadvantage of the production of these layers with inorganic photoconductors is the exact observation of the vapor deposition conditions of selenium or the exact adjustment of the mixtures in order to obtain a good photoconductive modification of the inorganic materials. Furthermore, the adhesion of selenium to conductive support material, such as to aluminium, is insufficient. Fatigue in repeated charge/exposure cycles does not allow the use in electrophotograhic copying devices.

Japanese Patent Application No. 43-26710 already discloses photoconductive double layers of organic materials on a conductive support. According to that application, a lower, relatively thick layer of a considerably diluted homogeneous solution of a sensitizer in a binder is provided with an upper transparent light-sensitive layer. This layer construction, however, only offers a relatively low sensitivity increase only little meeting technical demands. Another known suggestion according to German Offenlegungsschrift No. 1,909,742 is to repeatedly pour a sensitizer solution over a photoconductive layer and to evaporate the solvent. A disadvantage thereof is the low mechanical resistance of the applied layer as a result of insufficient cohesion and adhesion of the applied sensitizer. Furthermore, repeated coating is cumbersome.

The construction of photoconductive double layers containing a dyestuff layer is also known, e.g. from Belgian Pat. Nos. 763,389 and 763,541, but for this layer construction, top layers are used which allow no sensitivities satisfying highest demands and, as regards adhesion between the dyestuff layer and the top layer, do not represent an optimization and are not sufficiently resistant to mechanical attack, e.g. in electrophotographic copying devices, particularly to that due to the cleaning of the photoconductive layer.

SUMMARY OF THE INVENTION

It is the object of the present invention to provide an organic photoconductor layer highly light-sensitive for the xerograhic copying procedure which overcomes the described disadvantages and the adhesion of which between the various layers satisfies the highest technical demands, which exhibits no wear or fatigue and which, even after repeated use, may be used again rapidly.

The present invention provides an electrophotographic recording material consisting of an electroconductive support material with a photoconductive double layer of organic materials which consists of a homogeneous, opaque, charge carrier producing dyestuff layer from a more annealed quinone or the substitution product thereof, selected from the group consisting of dibenzopyrene quinone, anthanthrone, pyranthrone, dibenzanthrone, and flavanthrone, possible substituents being halogen, nitro, amino, hydroxy, alkoxy, mercapto or alkyl mercapto groups, and of a transparent top layer of insulating materials with at least one charge transporting compound and is characterized in that the transparent top layer consists of a charge transporting, monomer, heterocyclic compound substituted by at least one dialkyl amino group or two alkoxy groups and having an extended $\pi$-electron system or of a condensation product from 3-bromopyrene and formaldehyde and a binder.

DETAILED DESCRIPTION OF THE INVENTION

By means of the invention, it is possible to obtain highly light-sensitive, photoconductive double layers for the electrophotographic recording material of the invention which have a high mechanical resistance and may be arranged on a cylindrical drum, for example, or may circulate as an endless belt without exhibiting special signs of wear and thus are very suitable for the use in electrophotographic copying devices. The high light-sensitivity particularly results from the fact that the charge transporting compound present in the transparent top layer is sensitized by the charge carrier producing dyestuff layer in that the charge carriers, such as electrons or holes are taken by the top layer.

In a preferred embodiment, the organic dyestuff layer has a thickness in the range from about 0.005 to about 2 μm. High concentration of excited dyestuff molecules is achieved thereby in the dyestuff layer and at the boundary surface between the dyestuff layer and the top layer. It has proved that layer thicknesses from about 0.005 to about 1 μm may be completely sufficient and that even those in the range of about 0.001 μm may be effective. Furthermore, the adhesion between the electroconductive support material and the top layer is not impaired.

In a preferred embodiment, the transparent top layer has a thickness in the range from about 5 to about 20 μm. This assures a sufficiently high charge.

Figure 2:
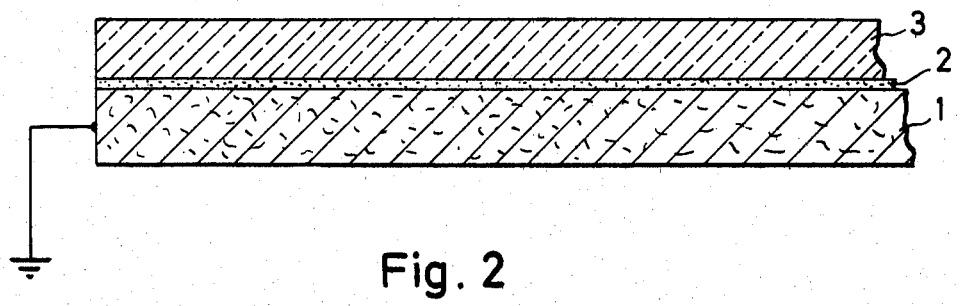
FIGS. 2 and 3 show the structure of the electrophotographic material.
Figure 3:
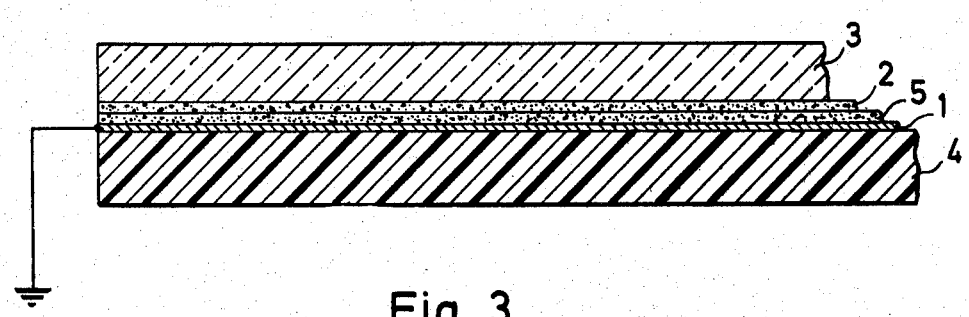

The structure of the electrophotographic recording material of the invention is illustrated by way of FIGS. 2 and 3. Numeral 1 means the electroconductive support material, numeral 2 the organic dyestuff layer, numeral 3 the organic, transparent top layer for charge transport. FIG. 3 shows a metallized plastic layer (1,4), and numeral 5 means the charge carrier injection inhibiting intermediate layer.

Suitable electroconductive support materials are materials which hitherto have been used for this purpose, for example aluminum foils or transparent plastic supports to which aluminum, gold, copper, zinc, cadmium, indium, antimony, bismuth, tin, lead or nickel has been laminated or applied by vapor deposition. Generally, every support material made sufficiently electroconductive may be used.

To the electroconductive support material, there may be applied an organic intermediate layer or a thermally, anodically or chemically produced aluminum oxide layer. The purpose of this layer is to decrease the charge carrier injection in the dark from the electroconductive support material into the organic dyestuff layer. It further guarantees a favorable influence of the adhesion between the support material and the dyestuff layer. Besides an inorganic oxide layer, it is also possible to use organic materials, such as natural or synthetic resin binders, which are little dissolved upon subsequent application of the top layer. Examples thereof are polyamide resins or polyvinyl phosphonic acid. The thickness of the intermediate layer is in the range from about $10^2$ to $10^4$ angstroms in the case of inorganic oxide layers and in the range of about 1 μm in the case of an organic intermediate layer.

The organic dyestuff layer from the more annealed quinones of the recording material of the invention substantially determines the spectral light-sensitivity of the photoconductive double layer of the invention. The structures of the annealed quinones are to be seen in the attached formula table, in which the formulae having the following meanings:

Formule 1 and 2 represent dibenzopyrene quinones such as dibenzo (b, def)-chrysene-7,14-dione (Indanthrene Gold Yellow GK, C.I. 59,100) and 2,9-dibromodibenzo (b, def)-chrysene-7,14-dione (Indanthrene Gold Yellow RK, C.I. 59,105).

Formulae 3 to 7 represent anthanthrones such as dibenzo (def, mno)-chrysene-6,12-dione or 4,10-disubstituted derivatives (Indanthrene Brilliant Orange GK, C.I. 59,305—Formula 3-, Indanthrene Brilliant Orange RK, C.I. 59,300—Formulae 4-, Indanthrene Scarlet FR-Formula 5 -, Vat Red Violet, C.I. 59,315 -Formula 6-, Vat Purple, C.I. 59,320—Formula 7-), Formula 8 (Indanthrene Red Brown RR, C.I. 59,500), Formulae 9 and 10 represent pyranthrene diones, such as 8,16-pyranthrene dione (Indanthrene Gold Orange G (pyranthrone), C.I. 59,700—Formula 9-), dibromo-8,16-pyranthrene dione (Indanthrane Orange RRTS, C.I. 59,705), Formula (9) $Br_2$—, the diaza-analogous compound of the pyranthrone (Indanthrene Yellow G (falvanthrone), C.I. 70,600-Formula 10-), Formulae 11 and 12 represent dibenzanthrones (Sandothrene Dark Blue BOA, C.I. 59,800-Formula 11 - and isoviolanthrone, C.I. 60,000—Formula 12 -).

The chemical designations were partly taken from "Chemical Abstracts", based on "The Ring Index", 2nd edition, "A Product of the Chemical Abstract Service", ASC, 1960.-

Particularly the halogen-substituted compounds have proved very suitable for the charge carrier producing dyestuff layer. In the double layer arrangement the dyestuffs of the invention have a very high photosensitivity in the visible spectral range, which is illustrated in the attached FIG. 1 for comparison with the photosensitivity of a photoconductor layer from a donor/acceptor complex. The reference photoconductor layer used is one according to German Auslegeschrift No. 1,572,347—Example 1. This shows the distinctly high light-sensitivity of the layers of the invention.

In addition to the high light sensitivity in the photoconductor layers, the dyestuffs of the invention have particular advantages as regards easy producibility, non-toxic properties, favorable application conditions by a relatively high termal and photochemical resistance, so that vapor deposition in the vacuum is possible for example without decomposition and decomposition under xerographic exposure conditions also does not occur.

The organic dyestuff layer must be extremely uniform since only its uniformity guarantees a uniform injection of charge carriers into the top layer.

To achieve this object, the dyestuff layers are applied according to special coating methods. Such methods are the application by mechanically rubbing the most finely powdered dyestuff material into the electroconductive support material, the application by chemical deposition of a leucobase to be oxidized, for example, the application by electrolytical or electrochemical processes or the gun spray method. The application preferably is performed, however, by vapor depositing the dyestuff in the vacuum. A tightly packed coating is achieved thereby.

The tightly packed coating makes it unnecessary to produce thick dyestuff layers for achieving a high absorption. The tighlty packed dyestuff molecules and the extremely low layer thickness permit, in a particularly advantageous manner, the transport of charge carriers so that it is completely sufficient to produce the charge carriers at the boundary layer only.

The application of the dyestuff layer by vapor deposition in the vacuum requires dyestuffs with thermal resistivity in the temperature range to be applied for vapor deposition. The high extinction of the dyestuff allows high concentration of excited dyestuff molecules. Excitation (1) and charge separation (2) take place in the dyestuff layer according to the following reaction equations:

$$S+h\nu \rightarrow S^* \quad (1)$$

$$S^* + S \rightarrow \cdot S^{\oplus} + S^{\ominus} \quad (2)$$

with

S—dyestuff molecule

S*—excited dyestuff molecule, and $\cdot S^{\oplus}, \cdot S^{\ominus}$—dyestuff radical ions At the boundary surface between the organic dyestuff layer and the transparent top layer, reactions of the excited dyestuff molecules or the resulting charge carriers in the form of the dyestuff radical ions with the molecules of the charge transport effecting compound in the top layer are possible according to the following equations:

$$S^* + F_1 \rightarrow \cdot S^{\ominus} + \cdot F_1^{\oplus} \quad (3)$$

$$S^* + F_2 \rightarrow \cdot S^{\oplus} + \cdot F_2^{\ominus} \quad (4)$$

$$\cdot S^{\oplus} + F_1 \rightarrow S + \cdot F_1^{\oplus} \quad (5)$$

$$\cdot S^{\ominus} + F_2 \rightarrow S + \cdot F_2^{\ominus} \quad (6)$$

with $F_1$—donor molecule $F_2$—acceptor molecule $\cdot F_1^{\oplus}, \cdot F_2^{\ominus}$—donor or acceptor radical ion At the boundary surface, sensitizing reactions take place between the transparent top layer and the organic dyestuff layer. The top layer thus is a sensitized organic photoconductor at least in the area of the boundary surface, which leads to the surprisingly high photoconductivity. Reactions 3 and 5 proceed preferably when the $\pi$-electron system in the top layer is a compound which, as a donor compound, easily can release electrons. This is the case with 2,5-bis-(4-diethylaminophenyl)-oxidazole-1,3,4, for example. But also heterocyclic compounds with only one dialkyl amino group are suitable for rapid procedure of reactions 3 and 5. Reactions 4 and 6 are preferably possible with a substance in the top layer which, as an electron acceptor, easily accepts electrons, e.g. 2,4,7-trinitrofluorenone or 3,6-dinitro-N-t-butyl-naphthalimide.

By means of the specific embodiment of the invention it is sufficient for the efficiency of the dyestuff when, besides its intense absorption, it only has either electron-attracting substituents, e.g. >C=O, halogen, or electron-repelling substituents, e.g. —O-alkyl, depending on whether it is preferably suitable for reactions 3, 5 or 4, 6. The invention permits charge carrier transport fostered by a particularly low expenditure of energy within the tightly packed dyestuff layer according to the following reactions:

$$\cdot S^{\oplus} + S \rightarrow S + \cdot S^{\oplus} \quad (7)$$

or $$S + \cdot S^{\ominus} \rightarrow \cdot S^{\ominus} + S \quad (8)$$

In all conventional sensitizing processes, however, transport via the dyestuff molecules present in low concentration is impeded by their large distance from one another.

Analogous is the charge transport in the top layer with:

$$\cdot F_1^{\oplus} + F_1 \rightarrow F_1 + \cdot F_1^{\oplus (p\text{-conductive})} \quad (9)$$

$$\cdot F_2^{\ominus} + F_2 \rightarrow F_2 + \cdot F_2^{\ominus (n\text{-conductive})} \quad (10)$$

The practical consequence of reactions 1 to 10 is that, in the use of electron donors in the top layer, the double layer arrangement is negatively charged so that reactions 3, 5, 8, 9 can proceed. In the inverse case, layers with electron acceptors in the top layer are positively charged so that reactions 4, 6, 7 and 10 can proceed.

The transparent top layer of organic insulating materials with at least one charge transporting compound is described as follows:

The transparent top layer has a high electric resistance and prevents in the dark the flowing off of the electrostatic charge. Upon exposure to light, it transports the charges produced in the organic dyestuff layer.

In the case of negative charge, the transparent top layer preferably consists of a mixture of an electron donor compound and a binder. But when the electrophotographic recording material is to be used for positive charge the transparent top layer consists of a mixture of an electron acceptor compound and a binder.

Consequently, in the transparent top layer there are used compounds for charge transport which are known as electron donors or electron acceptors. They are used together with binders or adhesives adapted to the compound for charge transport as regards charge transport, film property, adhesion, and surface characteristics. Furthermore, conventional sensitizers or substances forming charge transfer complexes are preferably additionally present. But they can only be used in so far as the necessary transparency of the top layer is not impaired. Finally, other usual additives such as levelling agents, plasticizers, and adhesives may also be present.

Suitable compounds for charge transport are especially those organic compounds which have an extended $\pi$-electron system, e.g. monomer aromatic heterocyclic compounds.

Monomers employed in accordance with the invention are those which have at least one dialkyl amino group or two alkoxy groups. Particularly proved have heterocyclic compounds, such as oxdiazole derivatives, which are mentioned in German Pat. No. 1,058,836. An example thereof is in particular the 2,5-bis-(p-diethylaminophenyl)oxdiazole-1,3,4. Further suitable monomer electron donor compounds are, for example, triphenyl amine derivatives, benzo-condensed heterocycles, pyrazoline or imidazole derivatives, as well as triazole and oxazole derivatives, as disclosed in German Pat. Nos. 1,060,260 and 1,120,875.

Also suitable are formaldehyde condensation products with various aromates, e.g. condensates from formaldehyde and 3-bromopyrene.

Besides these mentioned compounds having predominantly a p-conductive character, it is also possible to use n-conductive compounds. These so-called electron acceptors are known from German Pat. No. 1,127,218, for example. Compounds such as 2,4,7-trinitrofluorenone or N-t-butyl-3,6-dinitro-napthalimide have proved particularly suitable.

Suitable binders with regard to flexibility, film properties, and adhesion are natural and synthetic resins. Examples thereof are in particular polyester resins, e.g.

those marketed under the names Dynapol ® (Dynamit Nobel), Vitel ® (Goodyear), and which are copolyesters of iso- and terephthalic acid with glycol. Silicone resins as those known under the name SR of General Electric Comp., USA, or Dow 804 of Dow Corning Corp., USA, and representing three-dimensionally cross-linked phenyl-methyl siloxanes or so-called reactive resins as those known as DD lacquers and composed of an equivalent mixture of hydroxyl groups containing polyesters or polyethers and polyfunctional isocyanates, e.g. Desmophen ® and Desmodur ® of Bayer, Leverkusen, Germany, have proved suitable. Furthermore, copolymers of styrene and maleic acid anhydride, e.g. those known under the name Lytron ®, Monsanto, Chemical Comp., USA, but also polycarbonate resins, e.g. those known under the name Lexan Grade ® of General Electric, USA, are suitable for use.

The mixing ratio of charge transporting compound to binder may vary. Relatively certain limits are given, however, by the requirement for maximum photosensitivity, i.e. for the biggest possible portion of charge transporting compound, and for crystallization to be prevented, i.e. for the biggest possible portion of binder. A mixing ratio of about 1:1 parts by weight has proved preferable, but mixing ratios from about 3:1 to 1:4 or above, depending on the particular case, are also suitable.

The conventional sensitizers to be used additionally may advantageously foster charge transport. Moreover, they may produce charge carriers in the transparent top layers. Suitable sensitizers are, for example, Rhodamine B extra, Schultz, Farbstofftabellen (dyestuff tables), 1st volume, 7th edition, 1931, No. 864, page 365, Brilliant Green, No. 760, page 314, Crystal Violet, No. 785, page 329, and Cryptocyanine, No. 927, page 397. In the same sense as act the sensitizers may also act added compounds which form charge transfer complexes with the charge transporting compound. Thus, it is possible to achieve another increase of the photosensitivity of the described double layers. The quantity of added sensitizer or of the compound forming the charge transfer complex is so determined that the resulting donor acceptor complex with its charge transfer band still is sufficiently transparent for the organic dyestuff layer below. Optimum concentration is at a molar donor/acceptor ratio of about 10:1 to about 100:1 and vice versa.

The addition of adhesives as binders to the charge transporting compounds already yields a good photosensitivity. In this case, low-molecular polyester resin, such as Adhesive 49,000, Du Pont, has proved particularly suitable.

In the described manner, the top layers have the property to render possible a high charge with a small dark discharge. Whereas in all conventional sensitizations an increase of the photosensitivity is connected with an increase of the dark current, the arrangement of the invention can prevent this parallelity. The layers are thus usable in electrophotographic copying devices with low copying speeds and very small lamp energies as well as in those with high copying speeds and correspondingly high lamp energies.

The invention will be further illustrated by way of the following examples.

EXAMPLE 1

For the preparation of a multi-layer photoconductor layers, various dyestuffs are vapor deposited by a vacuum pump (Type Al of Pfeiffer, Wetzlar, Germany) at a reduced pressure of $10^{-3}$ to $10^{-4}$ mm Hg onto a 75 μm thick aluminum foil arranged at a distance of about 15 cm.

The vapor deposition conditions are as follows:

| | Dyestuff number according to the formula table | Duration of vapor deposition in minutes | Vapor deposition temperature in °C. |
|---|---|---|---|
| a | 1 | 1.5 | 250 |
| b | 2 | 2 | 270 |
| c | 3 | 1 | 280 |
| d | 4 | 2.5 | 340 |
| e | 5 | 3 | 350 |
| f | 6 | 1 | 280 |
| g | 7 | 3 | 280 |

The vapor deposited dyestuff layers are opaque, homogeneous, and mostly glossy, the layer weight is in the range from 0.01 to 1.0 g/m$^2$. For testing the electrophotographic properties of the various dyestuff layers, an about 10 μm thick top layer is applied by whirl-coating a solution of 4.0 g of 2,5-bis-(4-diethylaminophenyl)oxdiazole-1,3,4, 4.0 g of polyester resin, e.g. Dynapol L 206 of Dynamit Nobel, Troisdorf, Germany, and 4 mg of Brilliant Green (C.I. 42,040) in tetrahydrofurane as the solvent. The homogeneous, glossy layer is then dried for 5 minutes at 110° to 120° C.

For comparing the photosensitivities, an about 10 μm thick top layer of the described composition is prepared in the same manner on an aluminum foil without a dyestuff (zero layer). The thickness of the layer is determined by a thickness measuring device of Carl Mahr, Esslingen/Neckar, Germany.

For measuring the photosensitivity, the photoconductor double layer is negatively charged by passing it three times through a charging device (Type AG 56 of Kalle AG, Wiesbaden-Biebrich, Germany) adjusted to 7.5 kV. The layer is then exposed to an Osram xenon lamp (Type XBO 150); the intensity of illumination in the plane of measurement is about 300 1x. The charge height and the curve of the photo-induced light decay of the photoconductor layer are measured through a probe by an electrometer (Type 610 B of Keithley Instruments, USA). The results are summarized in Table I.

For characterizing the sensitivity of a photoconductor layer, the charge height ($U_o$) and the time $T_{\frac{1}{2}}$(msec) after which half of the initial charge ($U_o$) is achieved are indicated.

| Double layers | Dyestuffs see formula sheet | $U_o$ (V) negative charge | $T_{\frac{1}{2}}$(msec) (light decay) |
|---|---|---|---|
| Zero layer | without dyestuff | 1,400 | 280 |
| a | Formula I | 960 | 86 |
| b | Formula 2 | 1,200 | 190 |
| c | Formula 3 | 1,300 | 58 |
| d | Formula 4 | 1,050 | 21 |
| e | Formula 5 | 1,125 | 20 |
| f | Formula 6 | 1,300 | 42 |
| g | Formula 7 | 1,300 | 58 |

EXAMPLE 2

Homogeneous dyestuff layers are produced on aluminum foils as described in Example 1 d and each whirl-coated with a solution of the following compositions:

(a) 4.0 g of 2,5-bis-(4-diethylaminophenyl)-oxdiazole-1,3,4, 4.0 of polyester resin, e.g. Dynapol L 206 of Dynamit Nobel AG, Troisdorf, Germany, (b) 4.0 g of 2,5-bis-(4-diethylaminophenyl)-oxdiazole-1,3,4, 4.0 g of polyester resin, e.g. Dynapol L 206 of Dynamit Nobel AG, Troisdorf, Germany, and 0.4 g of 3,5-dinitrobenzoic acid.

The whirl-coater is so adjusted that the top layer has a thickness of about 8 to 11 μm. After pre-drying with a fan, the photoconductor layer is dried for about 5 minutes at 110° to 120° C. The photosensitivity is measured as described in Example 1. The following values for the dyestuff according to Formula 4 are obtained with different top layers:

| Double layer | $U_o$ (V) | $T_{\frac{1}{2}}$(msec) |
|---|---|---|
| a | 1,000 | 18 |
| b | 1,150 | 31 |

For use in xerographic copying machines, it is important that the photoconductor layer has no high dark decay ($\Delta U_D$). This value shows how rapidly a photoconductor layer is discharged in the dark.

The dark decay ($\Delta U_D$) of these layers was thus measured by a Dyn-Test apparatus of ECE, Giessen, Germany, and the following values were obtained with negative charge ($U_o$) after 2 seconds:

| Layer -Example- | $U_o$ (V) | $\Delta U_D$ |
|---|---|---|
| Zero layer | 1,275 | — |
| 2 a | 1,155 | 25 |
| 2 b | 1,220 | 110 |
| 1 d | 1,115 | 80 |

EXAMPLE 3

To dyestuff layers according to Formulae 5 and 10 prepared by vapor deposition on 75 μm thick aluminum foil, there is whirl-coated, in the case of dyestuff No. 5, a solution from 4 g of 2-phenyl-4-(2-chlorophenyl)-5-(4-diethylaminophenyl)-oxazole (A) according to German Pat. No. 1,120,875 and in the case of dyestuff No. 10 a solution from 4 g of 2,5-bis-(4-diethylaminophenyl)-oxadiazole-1,3,4 (B), and 4 g of polyester resin, e.g. Dynapol L 206, both solutions in 40 ml of tetrahydrofurane. After drying for about 5 minutes at 110° to 120° C., about 10 μm thick top layers are obtained.

For comparison purposes, an aluminum foil is coated with a top layer of the composition and thickness.

The photosensitivity is determined as follows:

On a slowly rotating disk, the photoconductor layer moves through a charging device (corona adjustment 7.0 kV, grid 1.5 kV) to the exposure section where it is exposed to an Osram xenon lamp, type XBO 150. A heat absorbing glass (type KG 3 of Schott+Gen., Mainz, Germany) and a neutral filter of 15 percent transparency are placed before the lamp so that the light intensity in the plane of measurement is 750 μW/cm². The charge height and the curve of the photo-induced light decay are oscillographically recorded by an electrometer (type 610 CR of Keithley Instruments, USA) through a transparent probe. The evaluation is performed as in Example 1.

| Double layer with Dyestuff No. | $U_o$ (V) negative charge | $T_{\frac{1}{2}}$(msec) |
|---|---|---|
| Zero layer (A) | 800 | 750 |
| 5 | 825 | 13 |
| Zero layer (B) | 900 | 240 |
| 10 | 1,000 | 11 |

Figure 1:
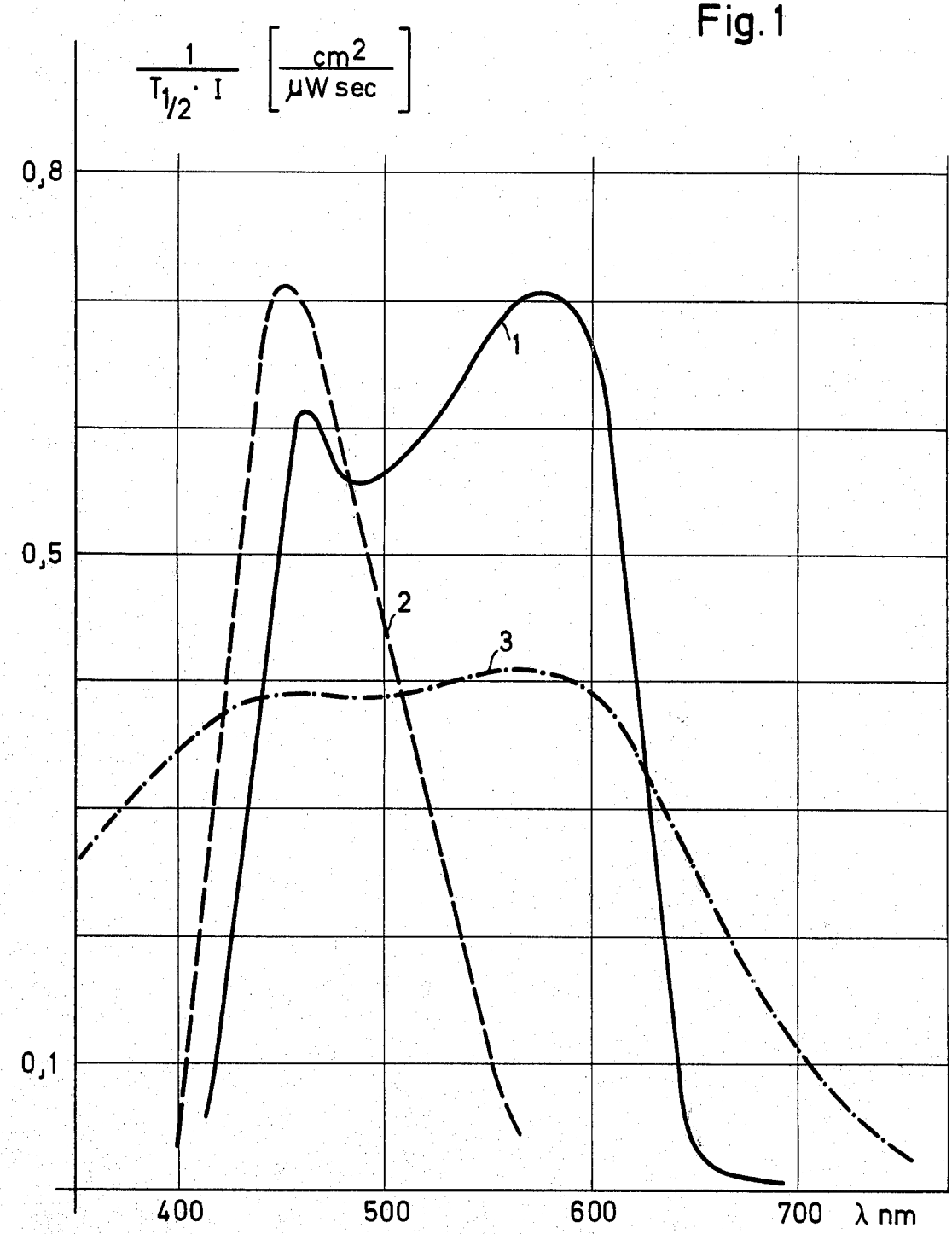
FIG. 1 shows the results of Example 3 which follows.

The spectral light-sensitivities of the two double layers are measured as follows:

The half time ($T_{\frac{1}{2}}$ msec) is determined for each wave length range at negative charge by exposure to a xenon lamp, type XBO 150, and placing therebefore monochromatic filters (line filters, half time width 10 to 12 nm, Schott+Gen., Mainz, Germany). By plotting the reciprocal values of the product from half time $T_{\frac{1}{2}}$ (sec) and light intensity $$I\left(\frac{\mu W}{cm^2}\right)$$

versus the wave length λ (nm), curve 1 is obtained for the double layer with dyestuff No. 5 and curve 2 for the double layer with dyestuff No. 10 (FIG. 1). The reciprocal value of $T_{\frac{1}{2}}$ . I means the light energy calculated per unit area which has to be irradiated in order to discharge the layer to half of its initial voltage $U_o$.

For comparing the photosensitivities, a photoconductor layer with a donor/acceptor complex as described in German Auslegeschrift No. 1,572,347 is used. This layer consists of polyvinyl carbazole and 2,4,7-trinitrofluorenone at a molar ratio of 1:1 (layer thickness about 12 82 m). Measured under the same conditions, this layer has a spectral sensitivity as recorded in curve 3 (FIG. 1).

EXAMPLE 4

Another photoconductor material used was bromopyrene resin. This product is obtained by condensation of 3-bromopyrene, melting point 94° to 95° C. (Organic Synthesis, Vol. 48 (1968), page 30) with formaldehyde in glacial acetic acid.

To dyestuff layers from 4,10-diiodo-dibenzo-(def, mno)-chrysene-6,12-dione (Formula 5) and flavanthrone (Formula 10), (vapor deposition conditions in Example 1, 2 minutes at 370° C. in the case of Formula 10), there is applied a solution from 2 parts by weight of bromopyrene resin and 1 part by weight of polyester resin. The thickness of the top layer is about 5 to 10 μm, depending on the adjustment of the whirl-coating.

The photosensitivity is measured as indicated in Example 3 (270 μW/cm² in the plane of measurement):

| Dyestuff (No.) | Thickness (μm) | $U_o$ (V) | $T_{\frac{1}{2}}$(msec) |
|---|---|---|---|
| Zero layer | 10 | −650 | 465 |
| 5 | 5 | −600 | 59 |
| | 10 | −825 | 63 |
| 10 | 5 | −650 | 27 |
| | 10 | −650 | 40 |

EXAMPLE 5

For the introduction of an intermediate layer (numeral 5 in FIG. 3) a 100 μm thick polyester film vapor deposited with aluminum is coated with a 1 percent solution from a polyamide resin, e.g. Elvamide 8061 of Du Pont, USA, in n-propanol/methanol. The thickness of this dried intermediate layer is below 1 μm.

The layer weight is about 0.2 g/m². To this precoated support material there are vapor deposited the dyestuffs (a) Indanthrene Gold Yellow GK (Formula 1), and (b) Vat Red Violet (Formula 6)

according to the conditions described in Example 1.

To these dyestuff layers, there is applied in tetrahydrofurane as the solvent a top layer consisting of 1 part by weight of 2,5-bis-(4-diethylaminophenyl)-oxdiazale-1,3,4 and of 1 part by weight of polyester resin. After drying (5 minutes at 120° C.), the layer thickness is about 10 μm.

The photosensitivity of this double layer is measured according to the method indicated in Example 3 (light intensity: 750 μW/cm² in the plane of measurement) and yields the following values:

| Example | $U_o$ (V) negative charge | $T_{\frac{1}{2}}$(msec) |
|---|---|---|
| a | 1,200 | 19 |
| b | 1,270 | 16 |

EXAMPLE 6

To 4,10-dibromo-dibenzo-(def,mno)-6,12-dione (Formula 4), the vapor deposition conditions of which are indicated under Example 1 *d*, there are applied the following top layers in thicknesses of about 10 μm.

(a)

1 part by weight of 2,5-bis-(4-diethylaminophenyl)-oxdiazale-1,3,4, 1 part by weight of a copolymer from styrene and maleic acid anhydride, e.g. Lytron 820 of Monsanto Comp., USA, solvent: tetrahydrofurane photosensitivity: negative charge: 1,070 V $T_{\frac{1}{2}}$=22 msec.

(b)

1 part by weight of 2,5-bis-(4-diethylaminophenyl)-oxdiazale-1,3,4, 1 part by weight of a polycarbonate resin, e.g. Lexan Grade® 141 of General Electric Co., USA, solvent: tetrahydrofuran photosensitivity: negative charge: 1,270 V $T_{\frac{1}{2}}$=13 msec.

The photosensitivity is measured according to the method described in Example 3 (light intensity: 750 μW/cm² in the plane of measurement).

EXAMPLE 7

Onto Vat Red Violet (Formula 6), there is whirl-coated a solution from 1 part by weight of 2,5-bis-(4-diethylaminophenyl)-oxdiazale-1,3,4 and 1 part by weight of silicone resin SR 182 (60 percent in toluene, General Electric Comp., USA) in toluene. After drying of the photoconductor layer, the layer thickness is about 10 μm.

The photosensitivity is determined as in Example 3:

negative charge: 830 V, $T_{\frac{1}{2}}$=17 msec.

EXAMPLE 8

To 4,10-dibromo-dibenzo (def, mno)-chrysene-6,12-dione (Formula 4), there is applied a solution from 1 part by weight of 2,5-bis-(4-diethylaminophenyl)-oxdiazale-1,3,4 and 1 part by weight of a lacquer component from equivalent quantities of Desmophen® 1100 (2 parts by weight) and Desmodur® HL (3 parts by weight), Bayer AG, Leverkusen, Germany. After drying (15 minutes at 120° C.), the layer thickness is about 10 μm.

The photosensitivity is measured in analogy with Example 3.

negative charge: 640 V, $T_{\frac{1}{2}}$=8 msec.

EXAMPLE 9

Dyestuffs layers from

Indanthrene Brilliant Orange GK (Formula 3)

Indanthrene Brilliant Orange RK (Formula 4)

Indanthrene Scarlet FR (Formula 5), and

Indanthrene Yellow G (Formula 10)

were produced on 100 μm thick aluminum foils as described in Example 1. These layers were then coated in a thickness of about 10 μm with a solution from 1 part by weight of 2,4,7-trinitrofluorenone-9 and 1 part by weight of polyester resin, e.g. Dynapol L 206 in tetrahydrofuran as the solvent. For comparison purposes, an aluminum foil was coated with this solution (zero layer).

The measurement of the photosensitivities of these double layers according to Example 3 yields the following values at positive charge with xenon light of an intensity of 487 μW/cm²:

| Double layer with dyestuff No. | $U_o$ (V) positive charge | $T_{\frac{1}{2}}$(msec) |
|---|---|---|
| Zero layer | 750 | >1,000 |
| 3 | 1,150 | 310 |
| 4 | 1,150 | 150 |
| 5 | 1,100 | 106 |
| 10 | 775 | 80 |

EXAMPLE 10

By vapor deposition on aluminum foil (100 μm) according to the conditions described in Example 1, the following dyestuff layers were produced:

| Dyestuffs according to Formula No. | | Duration of vapor deposition (minutes) | Temperature (°C.) |
|---|---|---|---|
| (1) | 2 | 2 | 270 |
| (2) | 8 | 5 | 350 |
| (3) | 9 | 3 | 350 |
| (4) | (9)$Br_2$ | 3 | 380 |

The dyestuff layers are homogeneous and opaque, the layer weight mostly is in the range from 0.01 to 0.6 g/m². The dyestuff layers were coated with an about 10 μm thick top layer from 1 part by weight of 2,5-bis-(4-diethylaminophenyl)-oxdiazale-1,3,4 and 1 part by weight of polyester resin, e.g. Dynapol L 206. The photosensitivity of these double layers was determined as in Example 3, the light intensity of the irradiated xenon light was 615 $\mu W/cm^2$. A zero layer was produced for comparison purposes.

| Double layer with dyestuff (No.) | $U_o$ (V) negative charge | $T_{\frac{1}{2}}$(msec) | $\Delta U_D$ (V) |
|---|---|---|---|
| Zero layer | 800 | 280 | — |
| 2 | 1,360 | 13 | 50 |
| 8 | 850 | 170 | 100 |
| 9 | 1,250 | 42 | 75 |
| (9)$Br_2$ | 1,250 | 19 | 120 |

The dark decay $\Delta U_D$ (after 2 seconds) was measured by a Dyn-Test 90 apparatus of ECE, Giessen, Germany, 2 seconds after the maximum voltage had been achieved.

EXAMPLE 11

A solution from poly-N-vinylcarbazole, e.g. Luvican® M 170 of BASF, Ludwigshafen, Germany, and 18.6 percent by weight, calculated on Luvican, of a low-molecular weight polyester resin, e.g. Adhesive 49 000 of Du Pont, USA, in tetrahydrofuran as the solvent is whirl-coated in different layer thicknesses onto the following homogeneous dyestuff layers (a) Vat Red Violet—Formula 6 —

(b) Sandothrene Dark Blue BOA—Formula 11 —

A zero layer without a dyestuff layer is produced for comparison purposes.

| Double layer | Top layer thickness ($\mu$m) | $U_o$ (V) negative charge | $T_{\frac{1}{2}}$(msec) |
|---|---|---|---|
| Zero layer | 6 | 550 | 1,000 |
| a | 10 | 1,125 | 720 |
| b | 7 | 650 | 800 |

EXAMPLE 12

From the dibenzanthrone products, the trans-compound (isoviolanthrone, Formula No. 12, C. I. 60,000, BASF) and Sandothrene Violet 4R (dichloro-isoviolanthrone, C.I. 60,010, Sandoz AG, Switzerland) were vapor deposited under the usual vapor deposition conditions, (see Example 1) within 2 to 3 minutes and 6 to 8 minutes, respectively, at 350° to 370° C. on aluminum foil (100 $\mu$m). Prior to vapor deposition, the commercial products had to be extracted with a solvent mixture from 1,2-dichlorobenzene/methanol in a ratio by volume of 1:1 in a Soxhlet apparatus.

The homogeneous dyestuff layers were then coated with a solution from 1 part by weight of 2,5-bis-(4-diethylaminophenyl)-oxdiazale-1,3,4 and 1 part by weight of polyester resin, e.g. Dynapol L 206. After drying, the thickness of the top layer was about 10 $\mu$m.

The photosensitivities of these double layers are determined as in Example 3 with xenon light and a light intensity of about 615 $\mu W/cm^2$. A top layer without a dyestuff layer serves as a reference

| Double layer with dyestuff/top layer | $U_o$ (V) negative charge | $T_{\frac{1}{2}}$(msec) |
|---|---|---|
| Zero layer | 800 | 280 |
| Isoviolanthrone | 1,050 | 58 |
| Sandothrene Violet 4 R | 1,200 | 44 |

It will be obvious to those skilled in the art that many modifications may be made within the scope of the present invention without departing from the spirit thereof, and the invention includes all such modifications.

What is claimed is:

1. An electrophotographic recording material consisting essentially of an electroconductive support material and a photoconductive double layer of organic materials which is composed of a tightly packed, homogeneous, uniform, opaque, unoriented, charge carrier producing dyestuff layer of a compound having an aromatic or heterocyclic polynuclear quinone ring system or the substitution product thereof, selected from the group consisting of dibenzopyrene quinone, anthanthrone, pyranthrone, dibenzanthrone and flavanthrone, substituents being selected from the group consisting of halogen and alkoxy groups, and a transparent top layer of 2,5-bis-(4-diethylaminophenyl)-oxdiazole-1,3,4, and a binder in a ratio by weight of about 1:1, which recording material is useful in an electrophotographic copying process with negative charging of the top layer, if an electron donating compound is used.

* * * * *

UNITED STATES PATENT AND TRADEMARK OFFICE

CERTIFICATE OF CORRECTION

PATENT NO. : 4,315,981

DATED : February 16, 1982

INVENTOR(S) : Wolfgang Wiedemann

It is certified that error appears in the above—identified patent and that said Letters Patent is hereby corrected as shown below:

Item 30 has been omitted and should read as follows:

--- Foreign Application Priority Data

July 31, 1972 (DE) Fed. Rep. of Germany....2237678 ---.

Column 1, line 11, --- an --- has been omitted after "to"; line 41, --- double --- has been omitted prior to "layers".

Column 4, line 14, "(falvanthrone)," should read --- (flavanthrone), ---; line 38, "termal" should read --- thermal ---; line 59, "tighity" should read --- tightly ---.

Column 5, line 7, the portion of equation (1) appearing after the arrow should read ---$_S^-$ ---; line 41, "-oxidazole-" should read --- oxdiazole- ---.

Column 10, line 36,"(12 82 m)." should read --- 12μm). ---

Column 11, line 12, "-oxdiazale-" should read --- -oxdiazole- ---; line 46, "oxdiazale-" should read --- oxdiazole- ---; line 61, "-oxdiazale-" should read --- -oxdiazole- ---.

Column 12, line 7, "oxdiazale-" should read --- oxdiazole- ---; line 65, "-oxdiazale-" should read --- -oxdiazole- ---;

UNITED STATES PATENT AND TRADEMARK OFFICE

CERTIFICATE OF CORRECTION

PATENT NO. : 4,315,981

DATED : February 16, 1982

INVENTOR(S) : Wolfgang Wiedemann

It is certified that error appears in the above-identified patent and that said Letters Patent is hereby corrected as shown below:

Column 14, line 7, "-oxdiazale-" should read -- -oxdiazole- --.

Signed and Sealed this

*Twentieth* Day of *July 1982*

[SEAL]

*Attest:*

GERALD J. MOSSINGHOFF

*Attesting Officer*

*Commissioner of Patents and Trademarks*